US005660965A

United States Patent [19]

Mychajlowskij et al.

[11] Patent Number: 5,660,965

[45] Date of Patent: Aug. 26, 1997

[54] TONER PROCESSES

[75] Inventors: Walter Mychajlowskij, Georgetown; Guerino G. Sacripante, Oakville; Raj D. Patel, Oakville; Daniel A. Foucher, Toronto, all of Canada

[73] Assignee: Xerox Corporation, Stamford, Conn.

[21] Appl. No.: 663,416

[22] Filed: Jun. 17, 1996

[51] Int. Cl.[6] ..... G03G 9/087

[52] U.S. Cl. ..... 430/137; 523/335; 524/457; 524/513

[58] Field of Search ..... 430/137; 524/513, 524/457; 523/335

[56] References Cited

U.S. PATENT DOCUMENTS

| | | | |
|---|---|---|---|
| 3,910,846 | 10/1975 | Azar et al. | 430/137 |
| 4,145,469 | 3/1979 | Newkirk et al. | 428/245 |
| 4,797,339 | 1/1989 | Marayama et al. | 430/109 |
| 4,983,488 | 1/1991 | Tan et al. | 430/137 |
| 4,996,127 | 2/1991 | Hasegawa et al. | 430/109 |
| 5,039,339 | 8/1991 | Phan et al. | 524/513 |
| 5,218,032 | 6/1993 | Sharma | 524/513 |
| 5,278,020 | 1/1994 | Grushkin et al. | 430/137 |
| 5,294,650 | 3/1994 | Sharma | 524/513 |
| 5,346,797 | 9/1994 | Kmiecik-Lawrynowicz et al. | 430/137 |
| 5,348,832 | 9/1994 | Sacripante et al. | 430/137 |
| 5,492,959 | 2/1996 | Clark | 524/457 |
| 5,593,807 | 1/1997 | Sacripante et al. | 430/137 |

*Primary Examiner*—Christopher D. Rodee
*Attorney, Agent, or Firm*—Ed Palazzo

[57] ABSTRACT

A process for the preparation of toner compositions, or toner particles comprising generating a latex comprised of a sulfonated polyester and olefinic resin in water; generating a pigment mixture comprised of said pigment dispersed in water; shearing said latex and said pigment mixture; adding an alkali (II) halide; stirring and heating to enable coalescence; followed by filtration and drying.

19 Claims, No Drawings

TONER PROCESSES

BACKGROUND OF THE INVENTION

The present invention is generally directed to toner processes, and more specifically, to aggregation and coalescence processes for the preparation of toner resins, especially polyesters, and toner compositions thereof. In embodiments, the present invention is directed to the economical preparation of toners and toner resins without the utilization of the known pulverization and/or classification methods, and wherein in embodiments toner compositions with a volume average diameter of from about 1 to about 25, and preferably from 1 to about 10 microns, and narrow GSD of, for example, from about 1.16 to about 1.26 as measured on the Coulter Counter can be obtained. The resulting toners can be selected for known electrophotographic imaging, printing processes, including color processes, and lithography. More specifically, with the processes of the present invention the use of surfactants is avoided, nonionic surfactant is not needed to disperse the pigment selected, cationic surfactant is not needed to disperse the aggregated particles formed, washing to remove surfactants is eliminated, heating to 20° C. to 40° C. above the resin Tg may be avoided, and the use of additional anionic surfactant may be avoided for stabilization of the aggregated particles formed prior to coalescence. The process of the present invention enables the utilization of polymers obtained by the emulsion free radical polymerization such as polystyrene-(meth)acrylates, poly(meth)-acrylates, and like, and wherein these particles are stabilized by a sodio sulfonated polyester dispersion, such as disclosed in U.S. Pat. No. 5,593,807, the disclosure of which is totally incorporated herein by reference, and wherein the toner particles are then generated by aggregating the aforementioned emulsion and a pigment with an alkali salt, such as magnesium chloride or barium chloride, followed by heating to coalesce the aggregate to toner sized particles ranging, for example, from about 3 to about 9 microns in diameter, and with a geometric distribution of from about 1.12 to about 1.35, and subsequently collecting the toner particles by filtration, optional washing and drying.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 are obtained. This process is thus directed to the use of coagulants, such as inorganic magnesium sulfate, which results in the formation of particles with a wide GSD. In U.S. Pat. No. 4,797,339, there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108, discloses a process for the preparation of a copolymer of styrene and butadiene by specific suspension polymerization. Other prior art that may be of interest includes U.S. Pat. Nos. 3,674,736; 4,137,188 and 5,066,560.

In U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites. Additionally, there is illustrated in U.S. Pat. No. 5,278,020, the disclosure of which is totally incorporated herein by reference, a process for the preparation of a toner composition comprising the steps of (i) preparing a latex emulsion by agitating in water a mixture of a nonionic surfactant, an anionic surfactant, a first nonpolar olefinic monomer, a second nonpolar diolefinic monomer, a free radical initiator and a chain transfer agent;

(ii) polymerizing the latex emulsion mixture by heating from ambient temperature to about 80° C. to form nonpolar olefinic emulsion resin particles of volume average diameter of from about 5 nanometers to about 500 nanometers;

(iii) diluting the nonpolar olefinic emulsion resin particle mixture with water;

(iv) adding to the diluted resin particle mixture a colorant or pigment particles, a sodio sulfo polyester resin and optionally dispersing the resulting mixture with a homogenizer;

(v) adding a cationic surfactant to flocculate the colorant or pigment particles to the surface of the emulsion resin particles;

(vi) homogenizing the flocculated mixture at high shear to form statically bound aggregated composite particles with a volume average diameter of less than or equal to about 5 microns;

(vii) heating the statically bound aggregate composite particles to form nonpolar toner sized particles;

(viii) halogenating the nonpolar toner sized particles to form nonpolar toner sized particles having a halopolymer resin outer surface or encapsulating shell; and (ix) isolating the nonpolar toner sized composite particles.

Furthermore, in U.S. Pat. No. 5,593,807, the disclosure of which is totally incorporated herein by reference, there is illustrated a surfactant free process comprised of forming a latex of a polyester, such as a sodium sulfonated polyester resin in water, mixing the latex with a pigment dispersion containing an alkali halide, such as calcium chloride, to form aggregates, and thereafter heating the formed aggregates to enable the generation of coalesced toner particles which are then filtered off and dried without washing, or with minimal washing. In the present invention, the sodio sulfopolyester resin is primarily utilized as a stabilizer for the generation of an emulsion latex comprised, for example, of a styrene-butadiene-acrylic acid, a styrene-(meth)-acrylate-acrylic acid or an alkyl (meth)-acrylate-acrylic acid, without the use of known nonionic or ionic surfactants, followed by aggregating the emulsion latex with a pigment dispersion and alkali (II) halide, such as magnesium chloride or barium chloride, and followed by heating to afford coalesced toner particles. The advantages associated with the toner process of this invention are, for example, that styrene or acrylate based toner resins are obtained without the use of surfactants, thus minimizing waste and excess washing steps of the toner.

Emulsion/aggregation processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797.

There is a need for an improved emulsion-aggregation-coalescence process for the preparation of toners with small particle size of from about 3 to about 7 microns in diameter and with narrow size particle distribution, such as from about 1.12 to about 1.35, and which process minimizes or avoids waste byproducts or reagents, such as surfactants, and wherein excessive washing is minimized or avoided. Furthermore, there is a need for styrene, (meth)-acrylate based toner resins, or a mixture of styrene or (meth)-acrylate and a polyester in order to obtain toners of low relative humidity, such as from about 1.2 to about 1.5, low fixing temperatures, such as from about 125° C. to about 145° C., excellent blocking characteristics, such as from about 50° C. to about 65° C., and of high gloss properties, especially for pictorial applications, such as from about 40 to about 80 gloss units as measured using the Gardner gloss metering unit.

These and other needs are obtained by the process of the present invention, which process comprises:

(i) preparing a latex emulsion by agitating in water a mixture of a sodio sulfopolyester, a first nonpolar olefinic monomer, a second polar olefinic monomer, a free radical initiator, and a chain transfer agent;

(ii) polymerizing the latex emulsion mixture by heating from ambient temperature to about 80° C. to form nonpolar olefinic emulsion resin particle composite comprised of an olefinic polymer resin and sulfo polyester resin of volume average diameter of from about 5 nanometers to about 500 nanometers;

(iii) diluting the resulting emulsion resin particle composite mixture with water;

(iv) adding to the diluted resin particle mixture a colorant or pigment, a sodio sulfopolyester resin, and optionally dispersing the resulting mixture with a homogenizer;

(v) adding an alkali (II) halide to the resulting mixture thereby forming a flocculation of resin particle composite and pigment;

(vi) homogenizing the resulting flocculated mixture at high shear to form statically bound aggregated composite particles with a volume average diameter of less than or equal to about 5 microns;

(vii) heating the resulting statically bound aggregate composite particles to form nonpolar toner sized particles; and (viii) isolating the nonpolar toner sized composite particles by filtration and drying.

SUMMARY OF THE INVENTION

It is an object of the present invention to provide toner compositions and processes thereof with many of the advantages illustrated herein.

In another object of the present invention there are provided simple and economical processes for the direct preparation of black and colored toner compositions with, for example, excellent pigment dispersion and narrow GSD.

Another object of the present invention resides in emulsion/aggregation processes for the preparation of toners, and wherein the use of surfactants is avoided.

In a further object of the present invention there is provided a process for the preparation of toner compositions with a volume average particle diameter of from between about 1 to about 20 microns, and preferably from about 1 to about 7 microns, and with a narrow GSD of from about 1.2 to about 1.3, and preferably from about 1.16 to about 1.25 as measured by a Coulter Counter.

In a further object of the present invention there is provided a process for the preparation of toners with particle size distribution which can be improved from 1.4 to about 1.16 as measured by the Coulter Counter by increasing the temperature of aggregation from about 25° C. to about 45° C.

Moreover, in a further object of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In another object of the present invention there is provided a composite toner of polymeric resin with pigment and optional charge control agent in high yields of from about 90 percent to about 100 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

These and other objects of the present invention are accomplished in embodiments by the provision of toners and processes thereof. In embodiments of the present invention, there are provided processes for the economical direct preparation of toner compositions comprising the stabilization of a latex dispersion with a sodio sulfopolyester in water, adding thereto a pigment and alkali (II) halide, such as magnesium chloride, to cause aggregation of the latex particle and pigment, under a high shear and up to the gelation point, such as a viscosity of about 100 centipoise; stirring the aggregated mixture; heating to enable coalesced resin particles and pigment; and thereafter accomplishing filtration to remove any residual salts; and then drying.

Embodiments of the present invention include a process for the preparation of toner compositions, or toner particles comprising generating a latex comprised of a sulfonated polyester and olefinic resin in water; generating a pigment mixture dispersed in water; microfluidizing said latex and said pigment mixture; adding an alkali (II) halide; stirring and heating to enable coalescence; followed by filtration and drying; and a process for the preparation of toner particles comprising:

(i) preparing a latex emulsion by agitating in water a mixture of a sodio sulfopolyester, a first nonpolar olefinic monomer, a second polar olefinic monomer, a free radical initiator and a chain transfer agent;

(ii) preparing a pigment dispersion in water by dispersing in water from about 10 to about 25 weight percent of a sulfonated polyester, and from about 1 to about 5 weight percent of pigment, which dispersion is prepared with a shearing device at from about 35° C. to about 45° C. for a duration of from about 1 hour to about 3 hours;

(iii) adding the pigment dispersion (ii) with shearing to a latex mixture comprised of sulfonated polyester and olefinic resin particles in water (i), followed by the addition of from about 1 to about 2 weight percent of alkali halide in water to enable aggregation of the latex and pigment particles as indicated by an increase in viscosity of from about 2 centipoise to about 100 centipoise;

(iv) heating the resulting mixture to a temperature of from about 45° C. to about 80° C. thereby causing further aggregation and coalescence resulting in toner particles comprised of a sulfopolyester resin, an olefinic resin, and pigment of from about 4 to about 9 microns in volume average diameter size and with a geometric distribution of less than about 1.3; and optionally (v) cooling the product mixture to about 25° C., and followed by washing and drying.

A process for the preparation of toner particles comprising:

(i) preparing a latex emulsion by agitating in water a mixture of a sodio sulfopolyester, a first nonpolar olefinic monomer, a second polar olefinic monomer, a free radical initiator and a chain transfer agent, and which latex emulsion is heated;

(ii) preparing a pigment dispersion in a water by dispersing in water from about 10 to about 25 weight percent of a sulfonated polyester, and from about 1 to about 5 weight percent of pigment, which dispersion is prepared with a shearing device, and wherein said shearing is accomplished by homogenizing at from about 1,000 revolutions per minute to about 10,000 revolutions per minute at a temperature of from about 25° C. to about 35° C. for duration of from about 1 minute to about 120 minutes;

(iii) adding the pigment dispersion (ii) with shearing to a latex mixture comprised of sulfonated polyester and olefinic resin particles (i) in water, followed by the addition of from about 1 to about 2 weight percent of an alkali halide in water to enable aggregation of latex and pigment as indicated by an increase in viscosity of from about 2 centipoise to about 100 centipoise, and wherein said shearing is accomplished by microfluidization at a temperature of from about 20° C. to about 80° C.;

(iv) heating the resulting mixture to a temperature of from about 45° C. to about 80° C. thereby causing further aggregation and coalescence, resulting in toner particles comprised of a pigment, sulfopolyester and olefinic resin of from about 4 to about 9 microns in volume average diameter size, and with a geometric distribution of less than about 1.3; and optionally (v) cooling the toner particles product mixture to about 25° C., followed by washing and drying.

In embodiments, the present invention is directed to processes for the preparation of toner compositions which comprise (i) the generation of a latex composite mixture containing a sodio sulfopolyester and alkyl (meth)-acrylate resins by charging a 1 liter vessel with about 200 to about 275 grams of isobutyl methacrylate, n-butyl methacrylate or mixtures thereof, with about 5 to about 25 grams of acrylic acid or methacrylic acid, with about 1 to about 10 grams of dodecanethiol, from about 1 to about 10 grams of carbon tetrabromide, and from about 2 to about 10 grams of ammonium or potassium persulfate, with about 400 to about 600 grams of water, and 60 to about 90 grams of sodio sulfopolyester resin with a glass transition temperature of about 45° C. to about 60° C., and molecular weight $M_w$ of about 2,000 to about 6,500 grams per mole as measured by gel permeation chromotography, and wherein the polyester is derived from about 3 to 10 mole percent of sodio-5-sulfoisophthalate, 42.5 to 47 mole percent of dimethylterephthalate or dimethylisophthalate, and 50 mole percent of a glycol or mixture of glycol, such as 1,2-propanediol, diethylene glycol or neopentyl glycol; (ii) heating the above mixture of from about 60° C. to about 85° C. for a duration of from about 3 to about 8 hours under an inert atmosphere, such as nitrogen or argon, thereby generating a surfactant-free latex comprised of composite particles of alkyl (metha)-acrylate-acrylic acid and sodio sulfopolyester resin particles; (iii) adding to a separate 2 liter glass kettle with about 100 to about 400 grams of the above latex, about 2.5 to about 20 grams of pigment particles, about 5 to about 10 grams of sodio sulfopolyester resin, and about 200 to about 600 grams of water, followed by slow, for example about one minute, addition of about 10 to about 50 grams of a 5 percent by weight aqueous solution of alkali (II) halide, such as magnesium chloride or barium chloride, forming a flocculation or aggregation of pigment and resin composite particles; (iv) homogenizing the flocculated mixture at high shear, such as from about 1,000 to about 10,000 revolutions per minute, for a duration of from about 2 minutes to about 1 hour to form statically bound aggregated composite particles with a volume average diameter of less than or equal to about 3 to 7 microns; (v) heating the statically bound aggregate composite particles to form nonpolar toner sized particles of from a temperature of about 45° C. to about 95° C. for a duration of from about 30 minutes to about 5 hours; and (vi) filtering the product and drying, such as air drying, freeze drying, spray drying or fluid bed drying.

In embodiments, the polyester resin selected for the processes of the present invention is a sodio sulfonated polyester, examples of which include those as illustrated in copending application U.S. Ser. No. 221,595, the disclosure of which is totally incorporated herein by reference, such as a sodio sulfonated polyester, and more specifically, a polyester, such as poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalatephthalate), copoly-(1,2-propylene-diethylene-sodio 5-sulfoisophthalate)-copoly-(1,2-propylene-diethylene-terephthalatephthalate), copoly-(ethylene-neopentylene-sodio 5-sulfoisophthalate)-copoly-(ethylene-neopentylene-terephthalate-phthalate), or copoly-(propoxylated bisphenol A)-copoly-(propoxylated bisphenol A-sodio 5-sulfoisophthalate). The sodio sulfonated polyestes resin is selected in various effective amounts, for example in an amount of from about 10 to about 25 weight percent of the emulsion latex, and which polyester possesses a glass transition temperature of, for example, from about 45° C. to about 60° C., and a molecular weight, $M_w$ of from 2,500 to about 8,000 grams per mole.

Various known colorants or pigments together with the polyester resin obtained and present in the toner in an effective amount of, for example, from about 1 to about 25 percent by weight of the toner, and preferably in an amount of from about 1 to about 15 weight percent, include carbon black like REGAL 330®; magnetites, such as Mobay magnetites MO8029™, MO8060™; Columbian magnetites; MAPICO BLACKS™ and surface treated magnetites; and the like. As colored pigments, there can be selected cyan, magenta, yellow, red, green, brown, blue, or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

The first olefinic monomer selected includes, for example, styrene, methyl acrylate, ethyl acrylate, propyl acrylate, butyl acrylate, hexyl acrylate, lauryl acrylate, methyl methacrylate, ethyl methacrylate, propyl methacrylate, butyl methacrylate, hexyl methacrylate, lauryl methacrylate, butadiene, isoprene, and the like, and this monomer is selected in various effective amounts of, for example, from about 20 to about 80 percent by weight of latex.

The second polar olefinic monomer selected for the process of this invention includes, for example, acrylic acid, methacrylic acid, and the like, and is selected in various effective amounts of, for example, from about 2 to about 8 percent by weight of the latex.

The alkali (II) halide selected includes, for example, berylium chloride, berylium bromide, berylium iodide, magnesium chloride, magnesium bromide, magnesium iodide, calcium chloride, calcium bromide, calcium iodide, strontium chloride, strontium bromide, strontium iodide, barium chloride, barium bromide, and barium iodide, and which halide is selected in various effective amounts, such as for example from about 1 to about 5 percent by weight of the latex.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLE I

A cyan toner comprised of about 5 weight percent of PV FAST BLUE™ and 95 percent by weight of a polymeric composite of about 15 weight percent of a sulfopolyester and 85 weight percent of terpolymer resin of isobutylacrylate-n-butyl methacrylate-acrylic acid was prepared as follows:

(i) Preparation of Latex Comprised of a Sodio Sulfopolyester and Terpolymer Resin of Isobutylacrylate-n-butyl Methacrylate-acrylic Acid To a one liter Parr reactor equipped with a mechanical stirrer were added 250 grams of isobutyl acrylate, 50 grams of n-butyl methacrylate, 5 grams of acrylic acid, 500 grams of water, 7.5 grams of potassium persulfate, 3 grams of dodecanethiol, 4 grams of carbon tetrabromide, and 50 grams of the polyester copoly(1,2-propylene-dipropylene-terephthalate)-copoly(1,2-propylene-dipropylene-5-sodiosulfo-isophthalate) with a glass transition temperature of about 54.6° C., a number average molecular weight ($M_n$) of 1,500 grams per mole, and a weight average molecular weight ($M_w$) of 3,160 as measured by gel permeation chromatography using polystyrene as standard. The mixture was then heated to 75° C. for a duration of 6 hours with purging of nitrogen, followed by cooling to room temperature, about 25° C.

(ii) Preparation of Pigment Dispersion

30 Grams of dry pigment (PV FAST BLUE™ available from BASF) and 250 grams of water were dispersed with 5 grams of the above sodio sulfopolyester resin using a microfluidizer at 80° C. for 1 hour.

(iii) Toner Preparation

75 Grams of the latex of step (i) were diluted with 75 grams of water, and mixed with 10 grams of pigment dispersion product of (ii) followed by shearing at 3,000 revolutions per minute using a Brinkman polytron for a duration of about 2 minutes. The resulting mixture was then heated to 45° C. with stirring and to this were added dropwise about 30 grams of a 1 percent by weight solution of magnesium chloride in water, during which time the viscosity of mixture increased from about 2 centipoise to about 100 centipoise. Stirring was then continued for an additional hour, after which the temperature was raised to about 50° C., and the mixture was maintained at this temperature for about 2 hours to result in toner particles with an average particle size of about 7.1 microns and GSD of 1.25 as measured by the Coulter Counter.

(iv) Collection of Product

The above mixture was then left to cool to room temperature, about 25° C., filtered off, washed with about 500 grams of water, and dried using a freeze dryer.

EXAMPLE II

A magenta toner comprised of about 5 weight percent of Fanal Pink and 95 percent by weight of polymeric composite of about 15 weight percent of sulfopolyester and 85 weight percent of terpolymer resin of isobutylacrylate-n-butyl methacrylate-acrylic acid was prepared as follows:

(i) Preparation of Latex Comprised of a Sodio Sulfopolyester and Terpolymer Resin of Isobutylacrylate-n-butyl Methacrylate-acrylic Acid To a one liter Parr reactor equipped with a mechanical stirrer were added 250 grams of isobutyl acrylate, 50 grams of n-butyl methacrylate, 5 grams of acrylic acid, 500 grams of water, 7.5 grams of potassium persulfate, 3 grams of dodecanethiol, 4 grams of carbon tetrabromide, and 50 grams of copoly(1,2-propylene-dipropylene-terephthalate)-copoly(1,2-propylene-dipropylene-5-sodiosulfo-isophthalate), with a glass transition temperature of about 54.6° C., a number average molecular weight ($M_n$) of 1,500 grams per mole, and a weight average molecular weight ($M_w$) of 3,160 as measured by gel permeation chromatography using polystyrene as standard. The mixture was then heated to 75° C. for a duration of 6 hours with purging of nitrogen, followed by cooling to room temperature.

(ii) Preparation of Pigment Dispersion

30 Grams of dry pigment (Fanal Pink obtained from BASF) and 250 grams of water were dispersed with 5 grams of the above sodio sulfopolyester resin using a microfluidizer at 80° C. for 1 hour.

(iii) Toner Preparation

75 Grams of the latex of (i) were diluted with 75 grams of water, and mixed with 10 grams of the pigment dispersion product of (ii) followed by shearing at 3,000 revolution per minute using a Brinkman polytron for a duration of about 2 minutes. The resulting mixture was then heated to 45° C. with stirring, and to this were added dropwise about 30 grams of a 1 percent by weight solution of magnesium chloride in water, during which time the viscosity of the mixture increased from about 2 centipoise to about 100 centipoise. Stirring was then continued for an additional hour, after which the temperature was raised to about 50° C., and the mixture was maintained at this temperature for about 2 hours to result in toner particles with an average particle size (volume average) of about 7.4 microns and GSD of 1.28 as measured by the Coulter Counter.

(iv) Collection of Product

The above mixture was then left to cool to room temperature, about 25° C., filtered off, washed with about 500 grams of water and dried using a freeze dryer.

EXAMPLE III

A cyan toner comprised of about 5 weight percent of PV FAST BLUE™, and 95 percent by weight of polymeric composite of about 15 weight percent of sulfopolyester and 85 weight percent of copolymer resin of isobutylacrylate-acrylic acid was prepared as follows.

(i) Preparation of Latex Comprised of a Sodio Sulfopolyester and Copolymer Resin of Isobutylacrylate-acrylic Acid To a one liter Parr reactor equipped with a mechanical stirrer were added 300 grams of isobutyl acrylate, 5 grams of acrylic acid, 500 grams of water, 7.5 grams of potassium persulfate, 3 grams of dodecanethiol, 4 grams of carbon tetrabromide, and 75 grams of copoly(1,2-propylene-dipropylene-terephthalate)-copoly(1,2-propylene-dipropylene-5-sodiosulfo-isophthalate), with a glass transition temperature of about 54.6° C., a number average molecular weight ($M_n$) of 1,500 grams per mole, and a weight average molecular weight ($M_w$) of 3,160 as measured by gel permeation chromatography using polystyrene as standard. The mixture was then heated to 75° C. for a duration of 6 hours with purging of nitrogen, followed by cooling to room temperature.

(ii) Preparation of Pigment Dispersion

30 Grams of dry pigment (PV FAST BLUE™ obtained from BASF) and 250 grams of water were dispersed with 5 grams of the above sodio sulfopolyester resin using a microfluidizer at 80° C. for 1 hour.

(iii) Toner Preparation

75 Grams of the latex of step (i) were diluted with 75 grams of water, and mixed with 10 grams of pigment dispersion product of (ii) followed by shearing at 3,000 revolutions per minute using a Brinkman polytron for a duration of about 2 minutes. The resulting mixture was then heated to 45° C. with stirring, and to this were added dropwise about 30 grams of a 1 percent by weight solution of magnesium chloride in water, during which time the viscosity of mixture increased from about 2 centipoise to about 100 centipoise. Stirring was then continued for an additional hour, after which the temperature was raised to about 50° C., and the mixture was maintained at this temperature for about 2 hours to result in toner particles with an average particle size of about 5.0 microns and GSD of 1.26 as measured by the Coulter Counter.

(iv) Collection of Product

The above mixture was then permitted to cool to room temperature, about 25° C., filtered, washed with about 500 grams of water, and dried using a freeze dryer.

Other modifications of the present invention may occur to those skilled in the art subsequent to a review of the present application and these modifications, including equivalents thereof, are intended to be included within the scope of the present invention.

What is claimed is:

1. A process for the preparation of toner compositions, or toner particles comprising generating a latex comprised of a sulfonated polyester and olefinic resin in water; generating a pigment mixture comprised of said pigment dispersed in water; shearing and mixing said latex and said pigment mixture; adding an alkali (II) halide to the resulting latex/pigment mixture; stirring and heating to enable coalescence; followed by filtration and drying.

2. A process in accordance with claim 1 wherein the halide is berylium chloride, berylium bromide, berylium iodide, magnesium chloride, magnesium bromide, magnesium iodide, calcium chloride, calcium bromide, calcium iodide, strontium chloride, strontium bromide, strontium iodide, barium chloride, barium bromide, or barium iodide.

3. A process in accordance with claim 1 wherein the halide is magnesium chloride selected in an amount of from about 1 to about 5 percent by weight of the latex.

4. A process in accordance with claim 1 wherein the resin latex is from about 0.01 to about 0.2 micron in volume average diameter, and the pigment particles are from about 0.01 to about 1 micron in volume average diameter.

5. A process in accordance with claim 1 wherein the pigment is carbon black, magnetite, cyan, yellow, magenta, and mixtures thereof.

6. A process in accordance with claim 1 wherein subsequent to filtration the toner particles isolated are from about 2 to about 15 microns in volume average diameter, and the geometric size distribution thereof is from about 1.15 to about 1.35.

7. A process in accordance with claim 1 wherein there is added to the surface of the formed toner metal salts, metal salts of fatty acids, silicas, metal oxides, or mixtures thereof in an amount of from about 0.1 to about 10 weight percent of the obtained toner particles.

8. A process in accordance with claim 1 wherein the halide is magnesium chloride.

9. A process in accordance with claim 8 wherein the sulfonated polyester is poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalatephthalate), copoly-(1,2-propylene-diethylenesodio 5-sulfoisophthalate)-copoly-(1,2-propylene-diethylene-terephthalatephthalate), copoly-(ethylene-neopentylene-sodio 5-sulfoisophthalate)-copoly-(ethylene-neopentylene-terephthalate-phthalate), or copoly-(propoxylated bisphenol A)-copoly-(propoxylated bisphenol A-sodio 5-sulfoisophthalate).

10. A process in accordance with claim 1 wherein said heating is from about 60° C. to about 85° C.

11. A process in accordance with claim 10 wherein said heating is for a duration of from about 3 to about 8 hours.

12. A process for the preparation of toner particles comprised of resin and pigment, and which process comprises microfluidizing and mixing a latex comprised of a sulfonated polyester and an olefinic resin in water with a pigment mixture dispersed in water; adding an alkali halide to the resulting latex/pigment mixture; stirring and heating to enable coalescence; followed by filtration and drying.

13. A process in accordance with claim 12 wherein the halide is magnesium chloride.

14. A process for the preparation of toner particles comprising:

(i) preparing a latex emulsion by agitating in water a mixture of a sodio sulfopolyester, a first nonpolar olefinic monomer, a second polar olefinic monomer, a free radical initiator and a chain transfer agent, and which latex emulsion is heated to form olefinic resin particles;

(ii) preparing a pigment dispersion in a water by dispersing in water from about 10 to about 25 weight percent of a sulfonated polyester, and from about 1 to about 5 weight percent of pigment, which dispersion is prepared with a shearing device at from about 35° C. to about 45° C. for a duration of from about 1 hour to about 3 hours;

(iii) adding the pigment dispersion (ii) with shearing to a latex mixture comprised of sulfonated polyester and olefinic resin particles (i) in water, followed by the addition of from about 1 to about 2 weight percent of an alkali halide in water to enable aggregation of latex and pigment as indicated by an increase in viscosity of from about 2 centipoise to about 100 centipoise;

(iv) heating the resulting mixture to a temperature of from about 45° C. to about 80° C. thereby causing further aggregation and coalescence, resulting in toner particles comprised of a pigment, sulfopolyester and olefinic resin of from about 4 to about 9 microns in volume average diameter size, and with a geometric distribution of less than about 1.3; and optionally (v) cooling the toner particles product mixture to about 25° C., followed by washing and drying.

15. A process in accordance with claim 14 wherein the sulfonated polyester is poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalatephthalate), copoly-(1,2-propylene-diethylenesodio 5-sulfoisophthalate)-copoly-(1,2-propylene-diethylene-terephthalatephthalate), copoly-(ethylene-neopentylene-sodio 5-sulfoisophthalate)-copoly-(ethylene-neopentylene-terephthalate-phthalate), or copoly-(propoxylated bisphenol A)-copoly-(propoxylated bisphenol A-sodio 5-sulfoisophthalate).

16. A process in accordance with claim 14 wherein the halide is added in a dropwise manner under high shear, and which addition is continued up to the gelation point, wherein there results an increase in viscosity of from about 10 to about 100 centipoise for the latex, and the aggregated mixture is heated from about 45° C. to about 80° C.

17. A process in accordance with claim 14 wherein the halide is magnesium chloride.

18. A process in accordance with claim 14 wherein the first olefinic monomer is styrene, methyl acrylate, ethyl acrylate, propyl acrylate, butyl acrylate, hexyl acrylate, lauryl acrylate, methyl methacrylate, ethyl methacrylate, propyl methacrylate, butyl methacrylate, hexyl methacrylate, lauryl methacrylate, butadiene, or isoprene selected in an amount of from about 20 to about 80 percent by weight of latex, and the second polar olefinic monomer is acrylic acid, or methacrylic acid selected in an amount of from about 2 to about 8 percent by weight of the latex.

19. A process for the preparation of toner particles comprising:

(i) preparing a latex emulsion by agitating in water a mixture of a sodio sulfopolyester, a first nonpolar olefinic monomer, a second polar olefinic monomer, a free radical initiator and a chain transfer agent, and which latex emulsion is heated to form olefinic resin particles;

(ii) preparing a pigment dispersion in a water by dispersing in water from about 10 to about 25 weight percent of a sulfonated polyester, and from about 1 to about 5 weight percent of pigment, which dispersion is prepared with a shearing device, and wherein said shearing is accomplished by homogenizing at from about 1,000 revolutions per minute to about 10,000 revolutions per minute at a temperature of from about 25° C. to about 35° C. for a duration of from about 1 minute to about 120 minutes;

(iii) adding the pigment dispersion (ii) with shearing to a latex mixture comprised of sulfonated polyester and olefinic resin particles (i) in water, followed by the addition of from about 1 to about 2 weight percent of an alkali halide in water to enable aggregation of latex and pigment as indicated an increase in viscosity of from about 2 centipoise to about 100 centipoise, and wherein said shearing is accomplished by microfluidization at a temperature of from about 20° C. to about 80° C.;

(iv) heating the resulting mixture to a temperature of from about 45° C. to about 80° C. thereby causing further aggregation and coalescence, resulting in toner particles comprised of a pigment, sulfopolyester and olefinic resin of from about 4 to about 9 microns in volume average diameter size, and with a geometric distribution of less than about 1.3; and optionally (v) cooling the toner particles product mixture to about 25° C., followed by washing and drying.

* * * * *